US005360159A

United States Patent [19]

Perriman

[11] Patent Number: 5,360,159

[45] Date of Patent: Nov. 1, 1994

[54] MAILERS AND BUSINESS FORM ASSEMBLIES FOR PRODUCING MAILERS

[75] Inventor: Victor H. Perriman, London, England

[73] Assignee: Moore Business Forms, Inc., Grand Island, N.Y.

[21] Appl. No.: 878,479

[22] Filed: May 5, 1992

[30] Foreign Application Priority Data

Aug. 15, 1991 [GB] United Kingdom ..... 9117589
Aug. 15, 1991 [GB] United Kingdom ..... 9117590

[51] Int. Cl.[5] ..... B65D 27/04; B65D 27/34; B65D 27/32

[52] U.S. Cl. ..... 229/92.3; 229/80.5; 229/314

[58] Field of Search ..... 229/92.1, 92.3, 69, 229/80.5, 314, 315

[56] References Cited

U.S. PATENT DOCUMENTS

| | | | |
|---|---|---|---|
| 3,273,785 | 9/1966 | Beckman et al. | 229/69 |
| 3,325,188 | 6/1967 | Hiersteiner | 282/11.5 |
| 3,329,332 | 7/1967 | Dagher, Jr. | 229/69 |
| 3,428,237 | 2/1969 | Dowen | 229/69 |
| 3,476,307 | 11/1969 | Faltin et al. | 229/69 |
| 3,511,015 | 5/1970 | Beckman et al. | 53/28 |
| 4,050,361 | 9/1977 | Traise | 93/1 |
| 4,148,430 | 4/1979 | Drake | 229/69 |
| 4,199,630 | 4/1980 | Consiglio | 428/43 |
| 4,320,868 | 3/1982 | Petersson | 229/75 |
| 4,455,809 | 6/1984 | Dallaserra | 53/435 |
| 4,575,121 | 3/1986 | Conti | 281/2 |
| 4,706,877 | 11/1987 | Jenkins | 229/69 |
| 4,824,142 | 10/1993 | Dossche | 282/11.5 |
| 4,911,354 | 3/1990 | Lombardo | 229/69 |
| 4,928,875 | 5/1990 | Hutchinson | 229/92.1 |
| 4,969,594 | 11/1990 | Ashby | 229/69 |
| 5,046,661 | 9/1991 | Kimura | 229/92.1 |
| 5,167,739 | 12/1992 | Hutchinson et al. | 229/69 |

FOREIGN PATENT DOCUMENTS

| | | |
|---|---|---|
| 40723/68 | 1/1970 | Australia . |
| 0058248 | 8/1982 | European Pat. Off. . |
| 0143622 | 6/1985 | European Pat. Off. . |
| 0201960 | 11/1986 | European Pat. Off. . |
| 0217674 | 4/1987 | European Pat. Off. . |
| 0251580 | 1/1988 | European Pat. Off. . |
| 0365192 | 4/1990 | European Pat. Off. . |
| 2252792 | 6/1975 | France . |
| 2163376 | 6/1973 | Germany . |
| 221425 | 4/1990 | New Zealand . |
| 1470993 | 4/1977 | United Kingdom . |

*Primary Examiner*—Stephen P. Garbe
*Attorney, Agent, or Firm*—Nixon & Vanderhye

[57] ABSTRACT

The invention relates to a sealed mailer or a business form assembly for providing a series of such mailers. In one form, the mailer has a folded edge and three other edges sealed by adhesive. A line of perforation extends along a first edge opposite the folded edge. Adhesive along the other two opposite edges is of a peel-apart arrangement such that after the first edge has been detached, the other two edges can be peeled apart to open out the mailer without significantly damaging the mailer. In another form, two rectangular sheets are sealed along all four edges with a line of perforation along a marginal edge portion of a first of the edges. Two edges adjacent the first edge and extending normal thereto are secured to one another by a peel-apart adhesive arrangement such that after the first edge portion has been torn off along the line of perforation, the two sheets from which the mailer is formed can be peeled apart from one another without significantly damaging the mailer.

5 Claims, 4 Drawing Sheets

FIG. 1
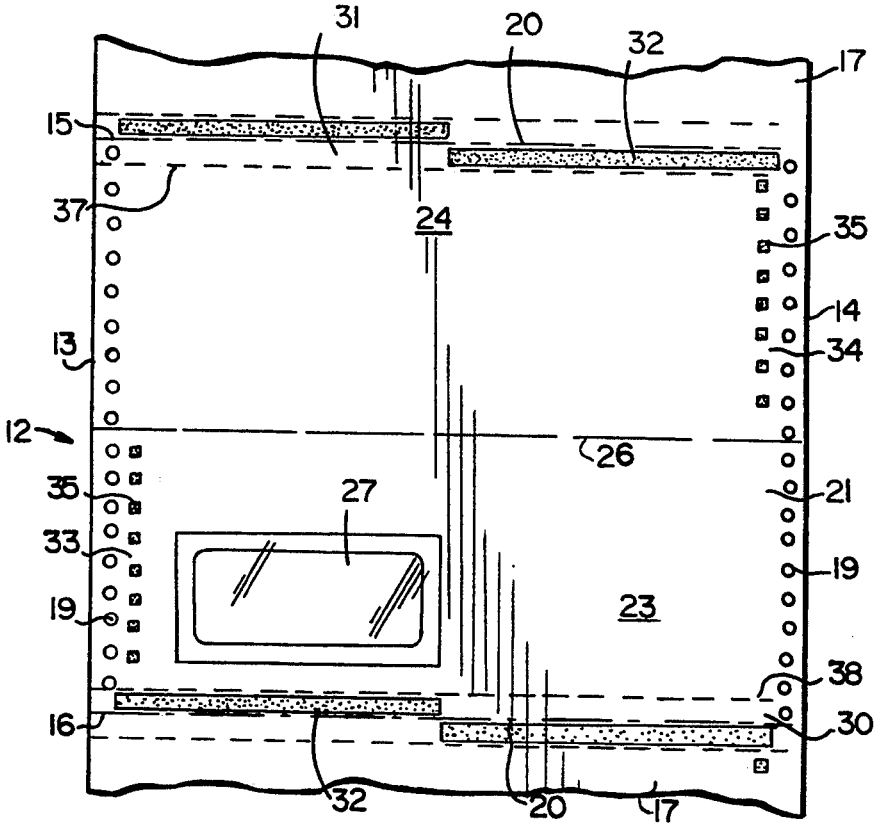
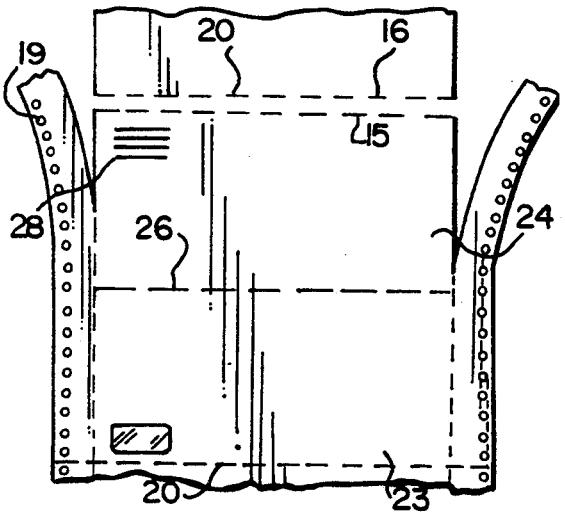
FIG. 2
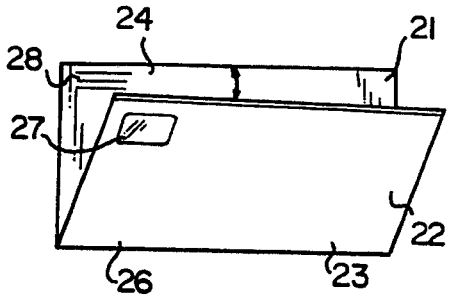
FIG. 3

FIG. 4
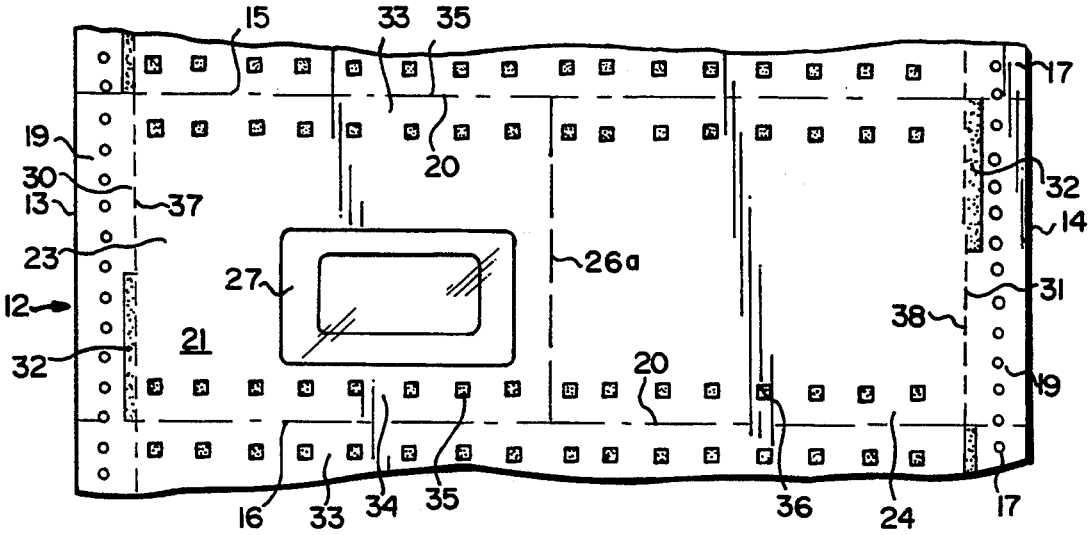
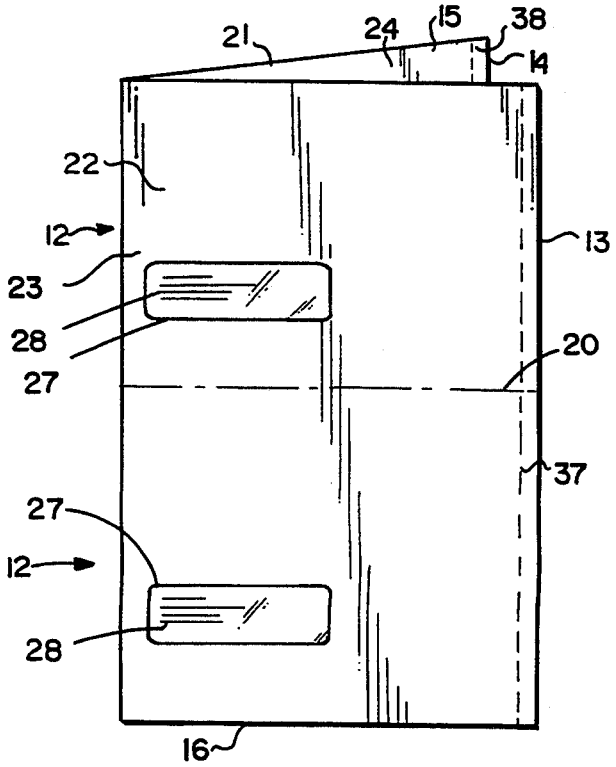
FIG. 5

MAILERS AND BUSINESS FORM ASSEMBLIES FOR PRODUCING MAILERS

BACKGROUND AND SUMMARY OF THE INVENTION

This invention relates to mailers and business form assemblies for producing such mailers.

In one aspect, the invention is particularly applicable to business form assemblies comprising a substantially continuous web containing a plurality of mailer forming units separable from one another by first transverse lines of perforation extending completely across the web, each mailer forming unit comprising a front sheet and a back sheet of similar size, the mailer forming unit carrying non-active, but activatable, adhesive such that a sealed mailer unit can be formed by folding the unit to bring the front and back sheets in register and activating the adhesive to form a seal along the three non-folded edges.

Conventional mailers have the three sealed edges detachable along perforation lines which extend inside the lines of adhesive so that after the marginal edge portions have been removed by tearing along the lines of perforation the mailer can be opened out along the fold line.

Accordingly, in one aspect, the invention provides a sealed mailer and a business form assembly for providing a series of such mailers, in which the mailer has a folded edge and three other edges sealed by adhesive. The mailer includes a line of perforation along a first edge opposite the folded edge and inside the substantially continuous line of adhesive sealing that edge. The adhesive along the other two opposite edges is of a peel-apart arrangement, e.g., a series of spaced small dots of adhesive with no adhesive between the dots. Thus, after the first edge has been detached, the other two edges can be peeled apart to open out the mailer without significantly damaging the mailer.

More particularly, the invention in this aspect thereof provides a business form assembly for forming a plurality of mailers, comprising a continuous web formed with a plurality of mailer forming units separated from one another by first transverse lines of perforation extending across the web. Each unit is formed with a central fold line such that the unit can be folded, after separation from the web, over along the central fold line to provide a sealed mailer having a front sheet and a back sheet in register with one another. At least parts of the edge portions parallel to the fold line carry a first non-active adhesive such that when such edges are brought together, a first substantially continuous line of adhesive is provided for sealing these edge portions together. A detachment line of perforations extends along the edge portions parallel to the fold line and inside the first adhesive line to define a tear-off margin. Portions of the edges normal to the fold line have a non-active second peel-apart adhesive arrangement therealong to seal the edge portions together. By removing the tear-off margin, the edge portions normal to the fold line can be peeled apart to open the mailer without significant damage thereto.

This aspect of the invention extends to mailers formed from such business form assemblies which have been folded and the adhesive activated to seal the units. Preferably, the adhesive is heat activatable or pressure activatable and the same adhesive is used for forming the substantially continuous adhesive line and for forming the peel-apart arrangements. The peel-apart arrangements comprise spaced-apart spots or discrete areas of adhesive separated by areas free of adhesive. The spacing is such that the area free of adhesive along the line of peel-apart adhesive is at least twice the area covered by adhesive, preferably three to six times as great and with advantage about four to five times as great. The central fold line of the mailer may extend transversely or longitudinally of the web, depending upon the desired dimensions.

The adhesive in this embodiment is arranged so that each half of the unit carries substantially half the adhesive. Where the adhesive is a heat seal adhesive, preferably the spots of the peel-apart adhesive of one half are interspaced between the spots of peel-apart adhesive on the other half when the unit is folded. Such an arrangement provides a balanced web and mailer unit. Where the adhesive is a pressure seal adhesive, the lines and spots must be the same on each sheet to register in contact with one another.

In another aspect, the invention utilizes separate message and cover sheets in which the message sheets are capable of being fed through a non-impact printer to have information printed on such message sheets, while the cover sheets bear all the adhesive for sealing the two sheets together after they have been collated so as to form a sealed mailer. In this aspect, the separate message and cover sheets are preferably provided in the form of continuous webs, the message web comprising a plurality of message sheets connected to one another by transverse lines of perforations and the cover web comprising a plurality of cover sheets connected to one another by transverse lines of perforations. The adhesive for securing the sheets together may be heat seal or pressure seal adhesive.

Such business form assemblies are described in European Patent Specification 0143622. However, the mailers of that specification are intended to be opened by tearing off four marginal edge portions along lines of perforations formed in both sheets.

Accordingly, in this second aspect of the present invention, there is provided a mailer and a business form assembly for forming such a mailer, in which the mailer is formed from two sheets sealed along all four edges. A line of perforations are provided along a first of the edges extending inside a substantially continuous line of adhesive along that marginal edge portion. At least the two edges adjacent the first edge and extending normal thereto are secured to one another by a peel-apart adhesive arrangement such as previously described in the first embodiment hereof. After the first edge portion has been torn off along the line of perforation, the two sheets from which the mailer is formed can be peeled apart from one another.

More particularly, this aspect of the invention provides a business form assembly for forming a mailer comprising a message sheet suitable for passage through a non-impact printer to receive information thereon. A cover sheet of a corresponding size to the message sheet is provided, each of the sheets having longitudinal and transverse edges. One of the sheets, preferably the cover sheet, carries adhesive along its four marginal edge portions such that when it is collated with a message sheet and the adhesive activated the sheets will adhere to one another along the edge to form a sealed mailer. The adhesive along a first of the edges of the cover sheet is formed in a substantially continuous line, the cover sheet being formed with a line of perforations parallel to the first edge and inwardly of the continuous line of adhesive. The message sheet is also formed with a line of perforations adapted to substantially overlie and lie in register with the line of perforations on the cover sheet when the sheets are collated. The adhesive along at least the two opposite edge portions of the cover sheet extending normal to the first edge is of a peel-apart arrangement as previously described.

Preferably, the business form assembly comprises a plurality of message sheets and a plurality of cover sheets, included respectively in a continuous message web and a continuous cover web, each comprising a plurality of such sheets separated from the adjacent sheets by transverse lines of perforations. In one form of this second embodiment, each message sheet and each cover sheet extends the full width of such webs. In another form, there are provided two cover sheets and two message sheets arranged side by side on the web, each separated from one another by a slit line extending longitudinally of the webs. A line of adhesive extends longitudinally adjacent and on each side of the central slid line of the cover sheet.

In a preferred embodiment according to the present invention, there is provided a sealed mailer comprising a first sheet and a second sheet overlying the first sheet, at least one of the sheets being suitable for passage through a printer for receiving information thereon, the sheets having longitudinal and transverse edges in respective registration one with the other. Means are provided for joining the registering longitudinal and transverse edges of the first and second sheets one to the other, thereby defining longitudinal and transverse edges of the mailer. The mailer has a line of perforations along the first and second sheets defining a margin adjacent one of the edges of the mailer and extending inside the joining means along the one mailer edge, the joining means along the one mailer edge including a substantially continuous line of adhesive along the margin. The first and second sheets along at least two of the joined edges thereof adjacent the one mailer edge and extending normal thereto are secured together by a peel-apart adhesive arrangement whereby, after the margin of the mailer has been torn off along the line of perforations, the first and second sheets can be peeled apart from one another without significantly damaging the mailer.

In a further preferred embodiment according to the present invention, there is provided a business form assembly for forming a plurality of mailers comprising a continuous web including a plurality of mailer forming units separable from one another by first transverse lines of perforations extending across the web, each unit, after separation from the web, having a central fold line such that the unit can be folded over along the central fold line to form a mailer having a front sheet and a back sheet in register with one another, edges of the front and back sheets in register with one another defining edge portions of the mailer perpendicular and parallel to the fold line. At least parts of an edge portion of the mailer parallel to the fold line carry a first non-active adhesive, such that, when the edges of the parallel edge portions are brought together, a first substantially continuous line of adhesive is provided for sealing the edge portions together. A detachment line of perforations extends along the edge portions parallel to the fold line and inside the first adhesive line, parts of the edges of the front and back sheets forming edge portions of the mailer normal to the fold line having non-active, non-continuous second lines of adhesive therealong, such that when the unit is folded to bring the edge together second peel-apart lines of non-continuous adhesive are provided for sealing these edges together along their lengths in a manner enabling the edges thereof to be peeled apart.

In a further preferred embodiment according to the present invention, there is provided a business form assembly for forming a mailer comprising a message sheet suitable for passage through a non-impact printer to receive information thereon, a cover sheet of a corresponding size to the message sheet, each of the sheets having longitudinal and transverse edges, one of the cover sheets and the message carrying adhesive along each of marginal edge portions adjacent the edges such that when the sheets are collated and the adhesive activated, the sheets will adhere to one another along their marginal edge portions to form a sealed mailer. The adhesive along a first of the edge portions of the one sheet is formed in a substantially continuous line, the one sheet being formed in a substantially continuous line of perforations parallel to the first edge portion and inwardly of the continuous line of adhesive, the other sheet being formed with a line of perforations adapted to substantially register with the line of perforations of the one sheet when the sheets are collated and the adhesive along at least the two opposite edge portions of the one sheet extending normal to the first edge portion being of a peel-apart type.

Accordingly, it is a primary object of the present invention to provide novel and improved mailers and business form assemblies for forming the mailers.

These and further objects and advantages of the present invention will become more apparent upon reference to the following specification, appended claims and drawings.

BRIEF DESCRIPTION OF THE DRAWING FIGURES

FIG. 1 illustrates a first embodiment of mailer forming unit forming part of a business form assembly according to the present invention;

FIG. 2 illustrates the web of FIG. 1 on a reduced scale;

FIG. 3 illustrates a mailer formed from the unit of FIG. 1, on a reduced scale and at a later stage of the processing;

FIG. 4 is similar to FIG. 1 showing a further form of the embodiment of FIG. 1;

FIG. 5 illustrates a later processing stage of the mailer units of FIG. 4;

DETAILED DESCRIPTION OF THE DRAWING FIGURES

Figure 6:
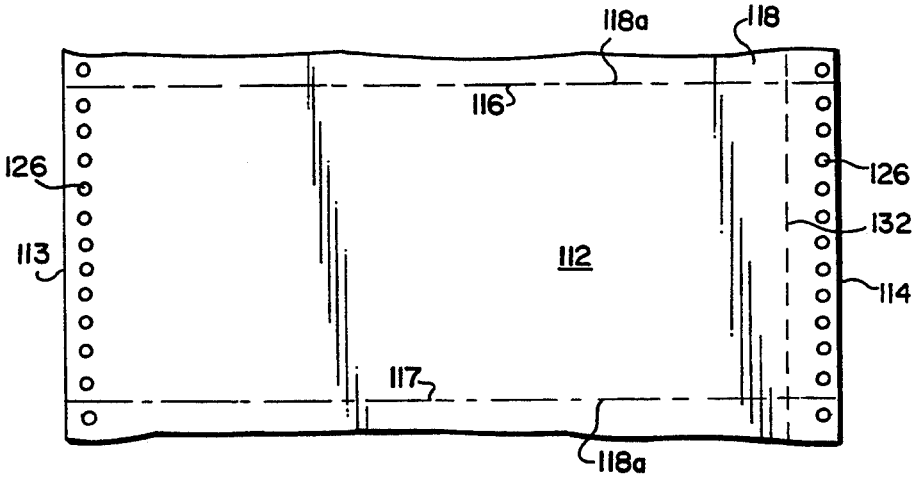
FIG. 6 illustrates a message sheet forming part of a message web of a second embodiment of the present invention.

Reference will now be made in detail to a present preferred embodiment of the invention, an example of which is illustrated in the accompanying drawings.

Referring now to FIGS. 1 to 3, a mailer forming unit 12 according to this invention has longitudinally extending edges 13, 14 and upper and lower transverse edges 15, 16. The unit 12 forms part of a continuous web 17 having a plurality of such units, with each unit separable from adjacent units by transverse lines of perforation 20. As particularly seen in FIG. 2, the lines of perforation 20, when broken, form the upper and lower of the transverse edges of the mailer. The lateral edges of the web are formed with sprocket guide holes 19 in a known manner. Each mailer forming unit has an inside face 21, an outside face 22, a front sheet 23 and a back sheet 24, the front and back sheets being separated from one another by a central fold line 26. Fold line 26 is also preferably perforated or scored as shown. The front sheet is formed, in a known manner, with a window 27 so that when the unit is folded, an address 28 will be viewable through the window.

Part of the edge portions 30, 31 of the edges parallel to the fold line 26 and which will form the opposite edge of the mailer to the fold line, carry non-active, but heat activatable, adhesive 32. When the edges are brought together, adhesive 32 will form a substantially continuous line of adhesive securing those edges one to the other. The edge portions 33, 34 extending normal to the fold line carry spaced-apart spots of non-active, but heat activatable, adhesive 35. When the unit is folded, adhesive 35 will provide a line of peel-apart adhesive along both such edges.

In a preferred form, each spot 36 of adhesive 35 is square or diamond-shaped, with each side having a length of 0.2 cms and the spots spaced apart by about 0.7 to 0.95 cms. It should be noted that approximately half of the adhesive is on the upper sheet and half on the lower sheet to provide a substantially even weighted and balanced unit. The adhesive may be activatable by other means, such as pressure, in which case similar complementary lines or spots of adhesive would be placed on each of the front and back sheets so that they would register in contact with one another when the unit is folded. Lines of perforations 37, 38 are formed adjacent the edge portions 31, 32 parallel to the central fold line 26 and inside the adhesive line 32.

The web may have pre-printed information thereon and information common to all forms. The business which wishes to send out the mailers will then pass the web through a printer to provide individualized information on each form, such as the addresses 28. The longitudinal edges carrying the perforations 19 are then detached and the individual units burst from one another along the perforation lines 20. The units are then folded as seen in FIG. 3 and passed through a sealer unit in which the adhesive is activated to form the sealed edges.

To open the unit, for example, when received through the mail, the edge opposite the fold line is torn off along the registering perforation lines 37, 38. The front and back sheets are then peeled apart from each other along edge portions 33, 34 to open the mailer.

The form of business form assembly of FIGS. 4 and 5 is substantially similar and like parts have been given like reference numerals and will not be re-described. In this form, the transverse fold line of FIGS. 1 to 3 has been replaced by a longitudinally extending fold line **26*a* and the tear-off edge extends longitudinally instead of transversely of the web. The edge portions 33, 34 carrying the heat activatable adhesive in a peel-apart arrangement, as previously described, have relatively widely spaced peel-apart spots of adhesive, with the spots on the top sheet and the bottom sheet, respectively, spaced at different distances from the fold line 26*a* so that they will be interspaced when the edges are brought together. A substantially continuous fold line could also be formed by interspaced patches of adhesive, some on the top and some on the bottom sheet, and the peel-apart spots could also be interspaced in the mailer of FIGS. 1 to 3**.

As illustrated in FIG. 5, the web is folded about the central longitudinal fold line **26*a***. The sprocket holes may then be detached and the web passed through a sealer unit to activate the glue and seal the edges. The units may then be detached from one another in a burster to provide the finished mailers.

Referring now to the embodiment hereof illustrated in FIGS. 6–11, there is illustrated a message sheet 112 having longitudinal edges 113, 114 and transverse edges 116, 117. The message sheet forms part of a continuous message web 118 provided with transverse lines of perforations **118*a* to divide the web into the message sheets, these lines coinciding with the transverse edges 116, 117. The message web 118** is of a form suitable for passing through a non-impact printer to receive personalized information and carries no heat sensitive adhesive.

A cover sheet 120 of the same size as the message sheet 112 has longitudinal edges 121, 122 and transverse edges 123, 124. The cover sheet forms part of a cover web 125 provided with transverse lines of perforations **125*a* to divide the web into a series of such cover sheets with the transverse edges 123, 124 coinciding with the lines 125*a* extending across the full width of the cover web. Both the cover web and the message web have a series of sprocket guide holes 126 along each longitudinal edge so that the webs can be accurately fed through a series of machines such as printers, adhesive supplying machines, collating machines, sealing machines and bursters. The cover sheet is provided in known manner with a window 127** so that a personalized address printed on the message sheet can be viewed through the window when the sheets are collated.

Figure 7:
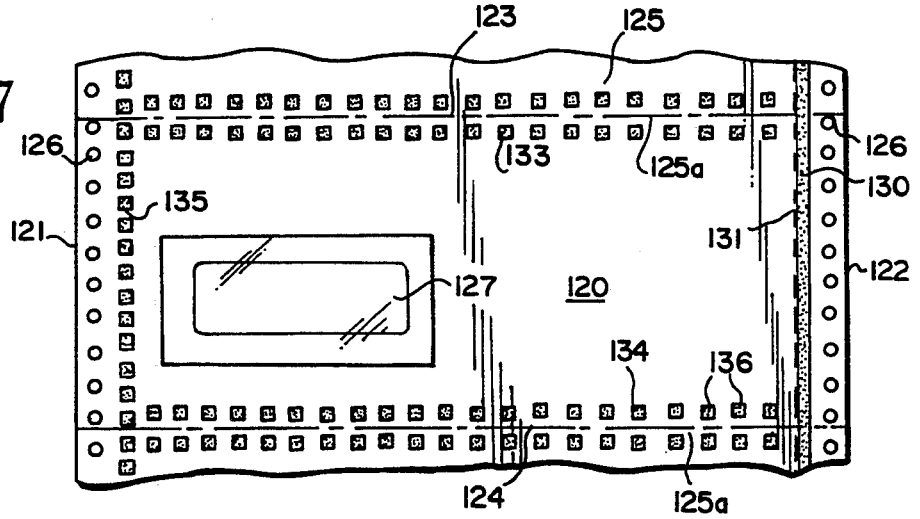
FIG. 7 illustrates a cover sheet forming part of a cover web for the message sheet web of FIG. 6.
Figure 10:
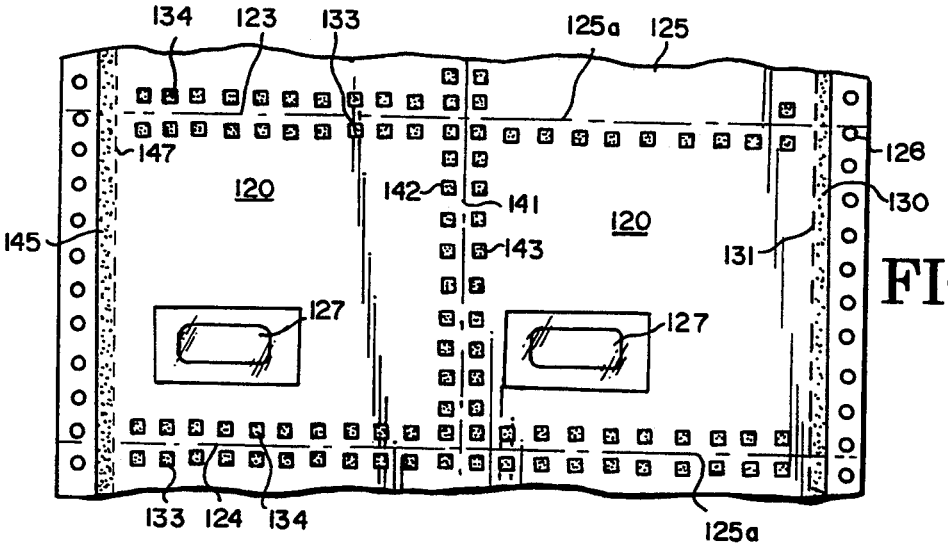
FIG. 10 illustrates a cover sheet forming part of a cover web for the message sheet of FIG. 9.

As shown in FIGS. 7 and 10, the cover sheet bears lines of adhesive. These adhesive lines are provided on the rear of the cover sheet but for clarity are shown on the front of the sheet.

The cover sheet has a substantially continuous line 130 of non-active but activatable adhesive along its longitudinal edge 122 inside the sprocket holes 126. In practice, this adhesive may be formed as a pattern of overlapping discrete areas to produce an effectively continuous line. The cover sheet has a line of perforations 131 adjacent its longitudinal edge 122 inside the line of adhesive 130. The message sheet has a line of perforations 132 arranged to overlie and be in register with the perforations 131 in the cover sheet when the sheets are laid on top of one another. Lines of adhesive 133, 134 and 135 of a peel-apart arrangement, similarly as previously described in the first embodiment of FIGS. 1–5, are located along the other three marginal edge portions of the cover sheet. Thus, the adhesive is of the same kind as that of the line 130 but comprises a series of spots or discrete areas spaced from one another so that the sheets can be pulled apart after being sealed together with very limited fiber tear of the sheets. In the preferred form, each spot 136 is substantially square or diamond-shaped with each side having a length of about 0.2 cms and the spots are spaced apart so that along the line of adhesive the adhesive free areas are three to nine times the adhesive areas, preferably four to six times.

The adhesive is preferably activated by heat but may be activated by other means such as pressure. In the latter case, the message sheet must bear complementary lines and spots of adhesive similar to those on the cover sheet but of a type substantially insensitive to the type of heat generated by a laser printer, so that the adhesive on the message sheet will register with and contact the adhesive on the cover sheet when they are brought together.

Figure 8:
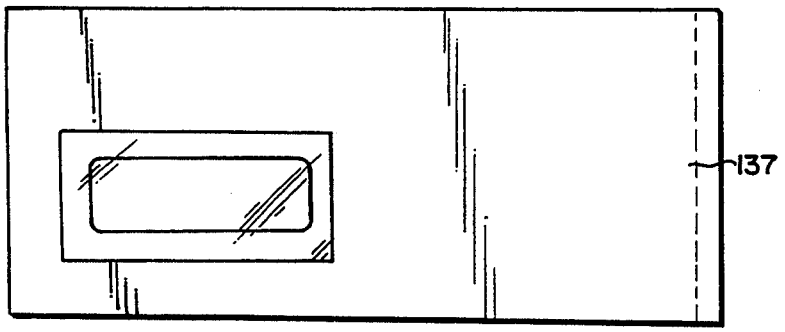
FIG. 8 illustrates a mailer formed from the sheets of FIGS. 6 and 7.

After the sheets 112 have been printed with personalized information, the sheets 112 and the sheets 120 are collated, that is, they are brought into overlying coinciding relationship one on top of the other and fed through a sealing machine which activates the adhesive to secure the sheets together around all four edges and form a series of connected mailers. The sprocket holes are normally then detached and the individual mailers separated from one another in a burster. FIG. 8 shows one such individual mailer 137.

Figure 9:
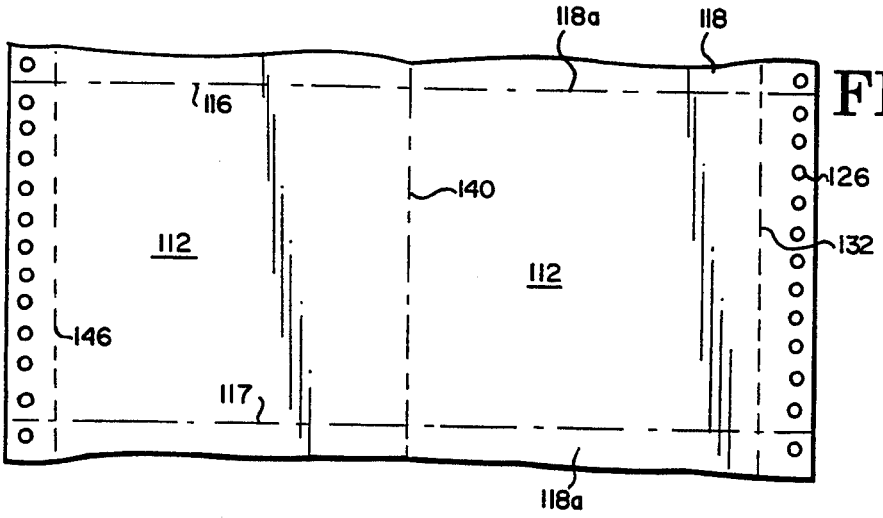
FIG. 9 illustrates an alternative form of message sheet forming part of a message web according to this second embodiment.
Figure 11:
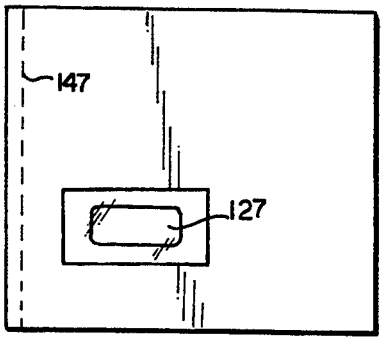
FIG. 11 illustrates a mailer formed from the message and cover sheets of FIGS. 9 and 10.

FIGS. 9 to 11 show another form of similar message sheets and cover sheets forming part of message webs and cover webs of this second embodiment and wherein similar parts have been given like reference numerals. In the arrangement of FIGS. 9 and 10, two message sheets and two cover sheets are located side by side with one another across the width of respective webs, in so-called two to view arrangement. The side-by-side sheets are separated by a respective central longitudinal slit lines 140, 141 and the cover sheet has two additional longitudinally extending lines of peel-apart adhesive 142, 143 adjacent the perforation line 141. The left hand side of the message web is formed with a substantially continuous line of adhesive 145 similar to line 130 and the message web and cover web are formed with lines of perforation 146, 147 inside the line of adhesive 145 and corresponding to the lines 131 and 132. The message sheets bear no heat sensitive adhesive.

Which marginal edge carries the line of substantially continuous adhesive and which edge portions carry the lines of peel-apart adhesive is a matter of choice.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sealed mailer comprising:

a first sheet and a second sheet overlying said first sheet, at least one of said sheets being suitable for passage through a printer for receiving information thereon;

said sheets having longitudinal and transverse edge portions in respective registration one with the other;

means for joining the registering longitudinal and transverse edge portions of said first and second sheets one to the other and thereby defining longitudinal and transverse edges of said mailer;

said mailer having registering lines of perforations along said first and second sheets defining a margin adjacent one of the edges of said mailer and extending inside the joining means along said one mailer edge, said joining means along said one mailer edge including a first line of adhesive extending in part along an edge portion of said first sheet a distance equal to about one-half the length thereof and leaving a remaining portion thereof void of adhesive and a second line of adhesive extending in part along an edge portion of said second sheet for a distance equal to about one-half the length thereof and leaving a remaining portion thereof void of adhesive, said adhesive along said edge portion of said first and second sheets lying in respective registration with the remaining portions void of adhesive whereby a substantially continuous line of adhesive along said margin is provided;

the first and second sheets along at least two of said joined edge portions thereof adjacent said one mailer edge and extending normal thereto being secured together by a peel-apart adhesive arrangement having spaced apart discrete areas of adhesive separated by areas free of adhesive, said discrete areas of said peel-apart adhesive lying on each edge portion of said two joined edge portions of said first and second sheets being interspaced between the discrete areas of said peel-apart adhesive on the registering edge portion of said two joined edge portions such that, when the mailer unit is folded to bring said two edge portions together, peel-apart lines of non-continuous adhesive are provided for sealing the perpendicular edge portions together along their lengths in a manner enabling the edges thereof to be peeled apart substantially without tearing one or the other of the first and second sheets.

2. A sealed mailer according to claim 1 in which the spaced-apart discrete areas of adhesive separated by areas free of adhesive are such that the total area free of adhesive along each line of discrete non-continuous adhesive areas is at least twice the total area covered by such adhesive.

3. A business mailer comprising:

a mailer forming unit having a central fold line such that the unit can be folded over along said central fold line to form a mailer having a front sheet and a back sheet in register with one another, and edges of said front and back sheets in register with one another defining edge portions of the mailer perpendicular and parallel to said fold line;

at least a part of each edge portion of the mailer parallel to the fold line carrying a first non-active adhesive and a part void of any adhesive, such that, when said edges of said parallel edge portions are brought together, the adhesive parts register with the void parts to provide a substantially continuous line of adhesive for sealing said parallel edge portions together;

a detachment line of perforations extending along said edge portions parallel to the fold line and inside said continuous line of adhesive, said edge portions of said front and back sheets perpendicular to the fold line having non-active, non-continuous second peel-apart lines of adhesive therealong, said peel-apart lines of adhesive comprising, along each perpendicular edge portion, spaced-apart discrete areas of adhesive separated by areas free of adhesive and being interspersed between the discrete areas of said peel-apart lines of adhesive on the registering edge portion, the spacing between said spaced-apart discrete areas of adhesive being such that the total area free of adhesive along each line of discrete non-continuous adhesive areas is at least twice the total area covered by such adhesive, whereby, when the mailer unit is folded to being said perpendicular edge portions together, the peel-apart lines of non-continuous adhesive seal said perpendicular edge portions together along their lengths in a manner enabling the edges thereof to be peeled apart.

4. A business mailer according to claim 3 in which said area free of adhesive is in the range of 3 to 6 times as great as the area covered by adhesive.

5. A business mailer according to claim 3 in which said area free of adhesive is in the range of 4 to 5 times as great as the area covered by adhesive.

* * * * *